US005141820A

United States Patent [19]

Sukimoto et al.

[11] Patent Number: 5,141,820

[45] Date of Patent: Aug. 25, 1992

[54] ALUMINUM PIPE FOR USE IN FORMING BULGED PORTIONS THEREON AND PROCESS FOR PRODUCING SAME

[75] Inventors: Minobu Sukimoto; Hitoshi Akiyoshi, both of Tochigi; Seijiro Taguchi; Kazuo Sugiyama, both of Ibaraki; Isao Watanabe, Tochigi, all of Japan

[73] Assignee: Showa Aluminum Corporation, Osaka, Japan

[21] Appl. No.: 637,574

[22] Filed: Jan. 4, 1991

[51] Int. Cl.[5] ..... C22F 1/04; F02M 35/10

[52] U.S. Cl. ..... 428/586; 148/437; 148/689; 29/890.08

[58] Field of Search ..... 148/11.5 A, 437, 440; 428/586; 123/52 M; 29/890.08

[56] References Cited

U.S. PATENT DOCUMENTS

| | | | |
|---|---|---|---|
| 3,104,189 | 9/1963 | Wagner | 148/440 |
| 3,222,763 | 12/1965 | Heuer | 148/11.5 A |
| 3,304,208 | 2/1967 | Jager | 148/11.5 A |
| 3,560,269 | 2/1971 | Anderson et al. | 148/11.5 A |
| 3,997,369 | 12/1976 | Grimes et al. | 148/11.5 A |
| 4,021,271 | 5/1977 | Roberts | 148/440 |
| 4,411,707 | 10/1983 | Brennecke et al. | 148/440 |
| 4,412,869 | 11/1983 | Vernam et al. | 148/437 |
| 4,483,719 | 11/1984 | Furrer et al. | 148/437 |
| 4,619,712 | 10/1986 | Miyamoto et al. | 148/11.5 A |
| 4,659,396 | 4/1987 | Lifka et al. | 148/440 |
| 4,829,944 | 5/1989 | Sukimoto et al. | 123/52 M |

FOREIGN PATENT DOCUMENTS

| | | | |
|---|---|---|---|
| 251180 | 1/1988 | European Pat. Off. | 123/52 M |
| 2817261 | 11/1978 | Fed. Rep. of Germany | 148/11.5 A |
| 142566 | 7/1980 | German Democratic Rep. | 148/11.5 A |
| 211127 | 7/1984 | German Democratic Rep. | 148/11.5 A |
| 57-54258 | 3/1982 | Japan | 148/11.5 A |
| 57-169072 | 10/1982 | Japan | 148/11.5 A |
| 63-268966 | 11/1988 | Japan | 123/52 M |
| 63-293144 | 11/1988 | Japan | 148/11.5 A |
| 2-104642 | 4/1990 | Japan | 148/11.5 A |
| 2-115563 | 4/1990 | Japan | 123/52 M |
| 711859 | 7/1954 | United Kingdom | 148/11.5 A |
| 216089YA | 7/1986 | United Kingdom | 148/11.5 A |

OTHER PUBLICATIONS

Metals Handbook, 9th Ed., vol. 4, "Heat Treating", American Society for Metals, Metals Park, Ohio, 1981, pp. 707-710.

*Primary Examiner*—John Zimmerman

*Attorney, Agent, or Firm*—Armstrong, Nikaido, Marmelstein, Kubovcik, and Murray

[57] ABSTRACT

An aluminum pipe according to the present invention is used in forming a plurality of bulged portions on the peripheral wall thereof. At the same time by bulging has been so refined as to exhibit an elongation of at least 40% and a recrystallization texture of up to 60 μm in grain size during bulging. The aluminum pipe to be bulged is produced by a process characterized by drawing an extruded aluminum pipe at a cold working ratio of at least 40%, and thereafter annealing the drawn pipe at a temperature of 350° to 420° C., whereby the pipe is refined to exhibit the specified elongation and recrystallization texture.

6 Claims, 1 Drawing Sheet

ALUMINUM PIPE FOR USE IN FORMING BULGED PORTIONS THEREON AND PROCESS FOR PRODUCING SAME

BACKGROUND OF THE INVENTION

The present invention relates to an aluminum pipe for use in forming a plurality of bulged portions as aligned on the peripheral wall thereof at the same time by bulging, and a process for producing the pipe.

The term "aluminum" as used herein and in the appended claims includes pure aluminum and aluminum alloys.

For example, motor vehicle intake manifolds are considered to be useful which comprise, as shown in FIG. 1, a tubular plenum chamber 1 of aluminum extrudate having an open end and closed at the other end, the peripheral wall of the chamber having a plurality of holes 2 and integrally formed with tubular outward projections 3 around the respective holes 2, and a plurality of branch pipes 4 made of wrought aluminum and joined to the respective projections 3, each with its one end fitted in the projection.

It appears easy to produce the tubular plenum chamber 1 of the manifold by bulging the peripheral wall of an extruded aluminum pipe 5 by a single operation to form a plurality of tubular bulged portions 6 aligned in a row and each having a closed end (see FIG. 2), thereafter forming a hole in the closing end wall 7 of each tubular bulged portion 6, and subsequently outwardly bending the hole-defining portion of each end wall 7 and enlarging the outer end of the bent portion by bulging to thereby form the outward projections 3 for attaching the branch pipes to the chamber and form the holes 2.

For the production of the tubular plenum chamber 1, however, the bulged portions 6 to be formed on the peripheral wall of the extruded aluminum pipe 5 must be given a height which is at least 14% of the outside diameter of the pipe 5. As a result, it has been impossible for a single bulging operation to form such tubular bulged portions 6 as aligned on the peripheral wall of the extruded aluminum pipe 5 which is of the usual type because the great working ratio needed produces a fracture in the bulged portion 6.

SUMMARY OF THE INVENTION

The main object of the present invention is to provide an aluminum pipe for use in forming bulged portions thereon free of the above problem and a process for producing the pipe.

The present invention provides an aluminum pipe for use in forming a plurality of bulged portions on the peripheral wall thereof at the same time by bulging, the aluminum pipe having been so refined as to exhibit an elongation of at least 40% and have a recrystallization texture of up to 60 μm in grain size.

According to the present invention, the aluminum pipe for use in forming the bulged portions thereon is produced by a process characterized by drawing an extruded aluminum pipe at a cold working ratio of at least 40%, and thereafter annealing the drawn pipe at a temperature of 350° to 420° C., whereby the pipe is refined to exhibit an elongation of at least 40% and a recrystallization texture of up to 60 μm in grain size.

The aluminum pipe of the present invention can be bulged to form a plurality of bulged portions in alignment on the peripheral wall of the pipe without producing any fracture in the bulged portions. Further because the bulged portions can be formed by a single bulging step, the present process is smaller in the number of steps than the conventional process and can therefore be practiced with greater ease.

DESCRIPTION OF THE PREFERRED EMBODIMENT

The aluminum pipe described above for use in forming bulged portions thereon is at least 40% in elongation and has a recrystallization texture which is up to 60 μm in grain size because the pipe can then be free of any fracture when the bulged portions, which are tubular and have a height of at least 14% of the outside diameter of the pipe, are simultaneously formed in alignment on the peripheral wall of the pipe. The grain size or crystal particle size is preferably up to 55 μm.

In the production process described above, the extruded aluminum pipe is drawn at a cold working ratio of at least 40% because if the ratio is less than 40%, the recrystallization texture formed by annealing the pipe will not be up to 60 μm in grain size and the elongation will be less than 40%. Preferably, the cold working ratio is at least 45%.

The drawn pipe is annealed at a temperature in the range of 350° to 420° C. since no recrystallization occurs if the temperature is lower than 350° C., whereas temperatures exceeding 420° C. produce larger crystal grains. Preferably, the annealing temperature is in the range of 380° to 410° C.

EXAMPLES and COMPARATIVE EXAMPLES

AA6063 alloy was made into two extruded pipes measuring 330 mm in length, 69.5 mm in outside diameter and 2.4 mm in wall thickness. Furthermore, extruded pipes of AA6063 alloy were drawn at varying cold working ratios to prepare pipes having the same size as above. Subsequently, all the pipes were annealed under varying conditions and thereafter checked for tensile strength, elongation and grain size.

Figure 1:
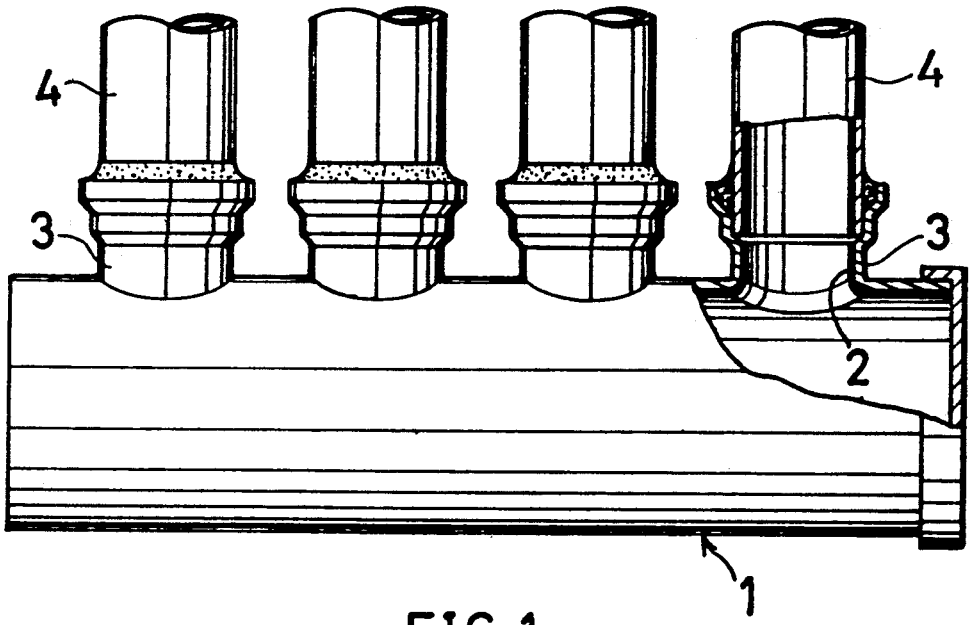
FIG. 1 is a side elevation partly broken away and showing the construction of an intake manifold.
Figure 2:
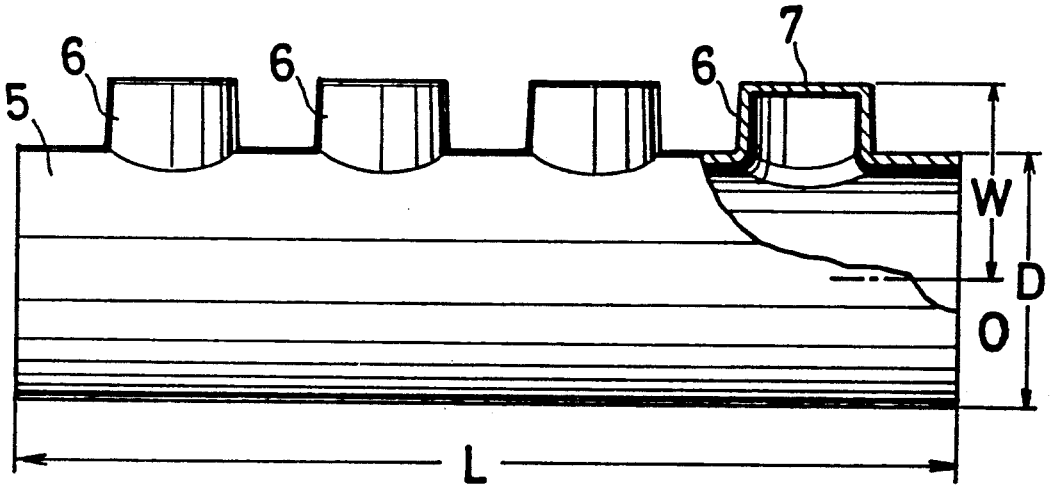
FIG. 2 is a side elevation partly broken away and showing an aluminum pipe having bulged portions formed during a process for producing the tubular plenum chamber of the intake manifold from the pipe.

All the pipes were thereafter bulged to form on the peripheral wall of each pipe four tubular bulged portions 6 arranged at a pitch of 59 mm in alignment as shown in FIG. 2. The pipes 5 having the bulged portions 6 were 260 mm in overall length L, 70 mm in outside diameter D, and 52 mm in the distance W from the central axis O to the outer end of the bulged portions 6. The bulged portions 6 of the pipes 5 were checked for fractures. The results are given in the table below, which also shows the cold working ratio, annealing conditions, tensile strength, elongation and grain size.

| | Cold working ratio (%) | Annealing Temp. (°C.) | Annealing Time (hr) | Tensile strength (kg/mm$^2$) | Elongation (%) | Grain size (μm) | Fracture |
|---|---|---|---|---|---|---|---|
| Example 1 | 47 | 400 | 2.5 | 9.8 | 42 | 55 | None |
| Example 2 | 43 | 400 | 2.5 | 9.9 | 40 | 60 | None |
| Example 3 | 47 | 375 | 2.5 | 9.6 | 44 | 53 | None |
| Comp. Ex. 1 | As extruded | 400 | 2.5 | 9.2 | 31 | 100 | Yes |
| Comp. Ex. 2 | As extruded | 450 | 2.5 | 10.5 | 26 | 290 | Yes |
| Comp. Ex. 3 | 30 | 400 | 2.5 | 10.1 | 35 | 70 | Yes |
| Comp. Ex. 4 | 30 | 450 | 2.5 | 12.5 | 26 | 280 | Yes |
| Comp. Ex. 5 | 47 | 450 | 2.5 | 10.7 | 28 | 260 | Yes |

The table reveals that the aluminum pipes which are at least 40% in elongation and up to 60 μm in the grain size of recrystallization texture can be bulged free of fracture to form the plurality of bulged portions as aligned in a row.

Although the present invention has been described above as embodied as aluminum pipes for use in intake manifolds for motor vehicles, the embodiments are in no way limiting upon the scope of the present invention. The invention is applicable also to other uses.

What is claimed is:

1. An aluminum pipe structure comprising:

an extruded aluminum pipe initially worked to a cold working ratio of at least 40% and thereafter annealed at a temperature of 350° to 420° C. so as to have an elongation of at least 40% and a recrystallization texture of up to 60 μm in grain size prior to formation of a plurality of bulged portions; and a plurality of bulged portions all formed simultaneously on a peripheral wall of said aluminum pipe, each of said plurality of bulged portions having a height at least 14% of an outside diameter of said aluminum pipe.

2. An aluminum pipe as defined in claim 1 wherein the grain size is up to 55 μm.

3. A process for producing an aluminum pipe structure comprising the steps of:

drawing an extruded aluminum pipe at a cold working ratio of at least 40%;

annealing the extruded aluminum pipe at a temperature of 340° to 420° C. so as to have an elongation of at least 40% and a recrystallization texture of up to 60 μm in grain size; and forming a plurality of bulges simultaneously on a peripheral wall of the aluminum pipe, each of the plurality of bulges having a height at least 14% of an outside diameter of the aluminum pipe.

4. A process as defined in claim 3 wherein the annealing temperature is 380° to 410° C.

5. A process as defined in claim 3 wherein the cold working ratio is at least 45%.

6. An aluminum pipe structure formed from a process having the steps:

extruding an aluminum pipe at a cold working ratio of at lease 40%;

annealing the extruded aluminum pipe at a temperature of 350° to 420° C. so as to have an elongation of at least 40% and a recrystallization texture of up to 60 μm in grain size; and forming a plurality of bulges simultaneously on a peripheral wall of the aluminum pipe, each of the plurality of bulges having a height at least 14% of an outside diameter of the aluminum pipe.

* * * * *